US008511782B2

(12) United States Patent
Chang et al.

(10) Patent No.: US 8,511,782 B2
(45) Date of Patent: Aug. 20, 2013

(54) METHOD FOR PRINTING ON A CURVED SURFACE

(75) Inventors: Yuan-Ping Chang, Taipei Hsien (TW); Ching-Ho Wei, Taipei Hsien (TW); Li-Chi Pai, Taipei Hsien (TW); Chang-Chin Wu, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 330 days.

(21) Appl. No.: 12/684,050

(22) Filed: Jan. 7, 2010

(65) Prior Publication Data

US 2010/0315459 A1 Dec. 16, 2010

(30) Foreign Application Priority Data

Jun. 10, 2009 (CN) ..... 2009 1 0147633

(51) Int. Cl.

| | |
|---|---|
| ***B41J 29/38*** | (2006.01) |
| *B41J 29/393* | (2006.01) |
| *B41J 2/01* | (2006.01) |
| *B41J 3/407* | (2006.01) |

(52) U.S. Cl.
USPC ..... 347/16; 347/14; 347/19; 347/105; 347/106

(58) Field of Classification Search
USPC ..... 347/16
See application file for complete search history.

(56) References Cited

U.S. PATENT DOCUMENTS

| | | | | |
|---|---|---|---|---|
| 5,815,282 | A * | 9/1998 | Kano | 358/296 |
| 6,360,656 | B2 * | 3/2002 | Kubo et al. | 101/35 |
| 6,538,767 | B1 * | 3/2003 | Over et al. | 358/1.18 |
| 7,168,803 | B2 * | 1/2007 | Baxter et al. | 347/101 |
| 7,407,250 | B2 * | 8/2008 | Jones et al. | 347/16 |
| 8,256,890 | B2 * | 9/2012 | Bauer | 347/104 |

FOREIGN PATENT DOCUMENTS

| | | |
|---|---|---|
| CN | 1148294 C | 5/2004 |
| CN | 100503240 C | 6/2009 |
| CN | 100524347 C | 8/2009 |

* cited by examiner

*Primary Examiner* — Laura Martin
*Assistant Examiner* — Jeremy Bishop
(74) *Attorney, Agent, or Firm* — Altis Law Group, Inc.

(57) ABSTRACT

A method for printing on a curved surface includes determining if a surface of a workpiece is curved, cutting an image to be printed into at least two printing areas if the surface is curved, and printing the printing area of the image on each surface of the workpiece. If the surfaces of the workpiece are not curved, the printing system directly prints the image on the workpiece. The printing system includes a rotating mechanism and a printer including an inkjet head having a plurality of nozzles. The workpiece is positioned on the rotating mechanism. The rotating mechanism rotates each surface of the workpiece to face the inkjet head and the inkjet head prints each printing area on it.

5 Claims, 4 Drawing Sheets

METHOD FOR PRINTING ON A CURVED SURFACE

BACKGROUND

1. Technical Field

The disclosure generally relates to printing systems, and particularly to a method for printing on a curved surface.

2. Description of Related Art

Computer printers generally work with sheet media such as paper or transparencies. Distances from ink nozzles of the printer to the printing surface are constant because the printing surface of the paper is planar.

The typical printer cannot print on three-dimensional surfaces, due to the varying distance from nozzles of the printer to the printing surface. This results in image distortion and generally poor print quality.

What is needed, therefore, is a method for printing on a curved surface addressing the limitations described.

DETAILED DESCRIPTION OF THE EMBODIMENTS

Figure 1:
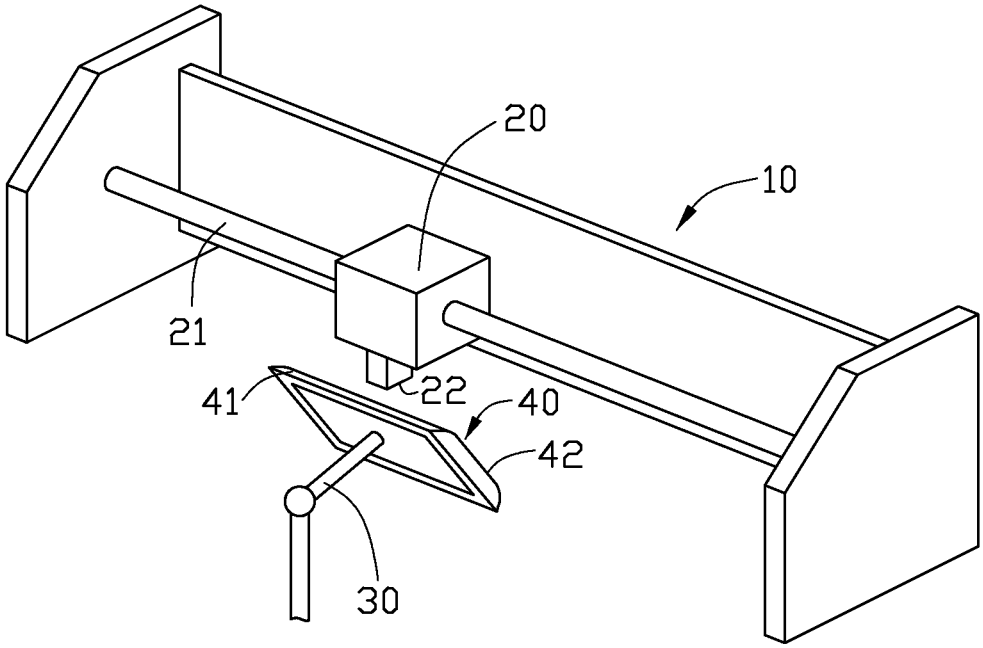
FIG. 1 is a perspective view of one embodiment of a printing system employing one embodiment of a method for printing on a curved surface.
Figure 4:
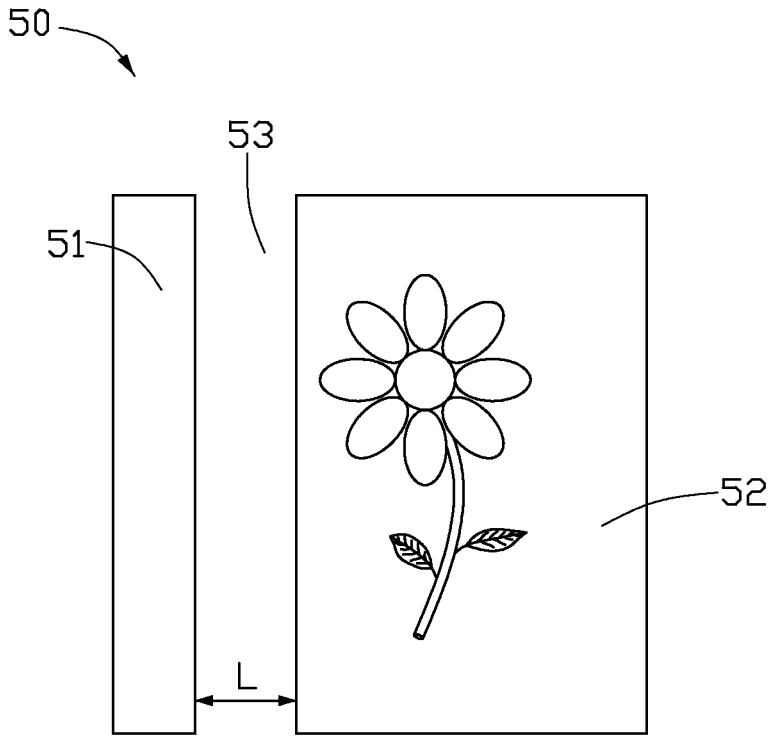
FIG. 4 is a diagram of a printing scope of the printing system of FIG. 1.

Referring to FIG. 1, a printing system 10 employing one embodiment of a method of printing on a curved surface, includes a printer (not labeled) and a rotating mechanism 30. The printer includes an inkjet head 20 having a plurality of nozzles 22 and a slide rail 21. The inkjet head 20 is on a slide rail 21, allowing it to move laterally to print an image 50 (as FIG. 4 shows) on surfaces of a workpiece 40. The workpiece 40 includes a first surface 41 and a second surface 42 to be printed on. Here, the first surface 41 is a curved surface and the second surface 42 is planar. The workpiece 40 is positioned on the rotating mechanism 30. The rotating mechanism 30 is configured for rotating the first surface 41 or the plane surface 42 of the workpiece 40 to face the inkjet head 20.

Figure 2:
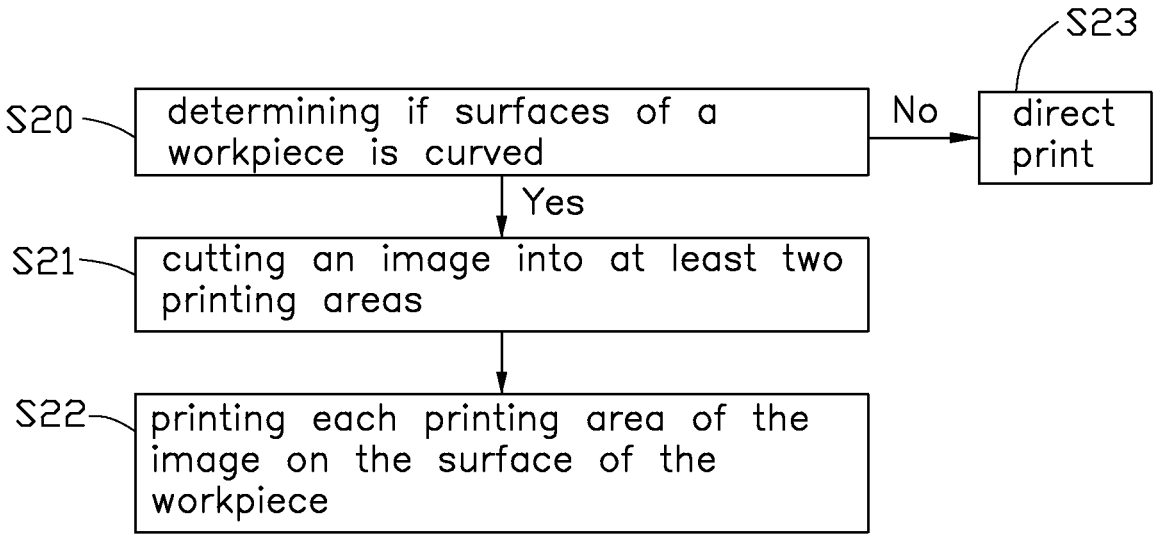
FIG. 2 is a block diagram of one embodiment of a method for printing on a curved surface.

Referring to FIG. 2, the method includes the following.

In step S20, a surface of the workpiece 40 is selected. If the selected surface of the workpiece is curved, the method continues to step 21, and the selection of the curved surface of the workpiece 40 is confirmed. If the surface of the workpiece is not curved, the method continues to step 23, and direct printing begins.

Figure 3:
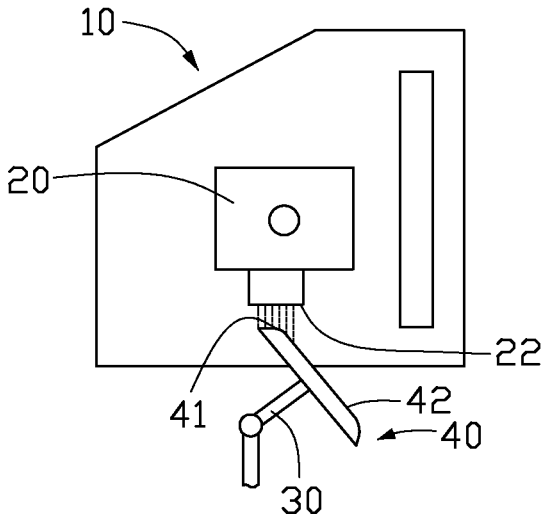
FIG. 3 is a sectional view of the printing system of FIG. 1.

In step S21, the image is separated into at least two printing areas. Referring to FIG. 3, if the first surface 41 and the second surface 42 are printed in the same process, the first nozzle prints on the first surface 41, and the last nozzle prints on the second surface 42. Referring to FIG. 4, the image 50 is cut into at least two printing areas 51, 52 corresponding to the first surface 41 and the second surface 42, respectively. A buffer area 53 is positioned between the two printing areas 51, 52. A width L of the buffer area 53 is greater than the distance of the first nozzle to the last nozzle of the inkjet head 20. The distances from multiple nozzles 22 of the printing head 20 to each surface of the workpiece 40 may be almost constant. The image 50 can be cut into several printing areas according to different surfaces of the workpiece 40.

In Step S22, each printing area of the image is printed on each surface of the workpiece. For example in the illustrated embodiment, the rotating mechanism 30 rotates the first surface 41 of the workpiece 40 to face the inkjet head 20. The inkjet head 20 of the printing system 10 prints one printing area 51 of the image 50 on the first surface 41 of the workpiece 40. The rotating mechanism 30 rotates the second surface 42 of the workpiece 40 to face the inkjet head 20. The inkjet head 20 of the printing system 10 prints the other printing area 52 of the image 50 on the second surface 42 of the workpiece 40. The buffer area 53 is positioned between the two printing areas 51, 53 because the image 50 is cut into at least two printing areas 51, 52 corresponding to the first surface 41 and the second surface 42.

In Step S23, printing commences. The inkjet head 20 of the printing system 10 directly prints the image on the workpiece 40. The first surface 41 and the second surface 42 are printed in different printing processes, so that the nozzles can be properly positioned, resulting in a good three-dimensional printing quality.

It should be noted that the image 50 can be cut into multiple printing areas according to different surfaces of the workpiece 40. The rotating mechanism 30 rotates each surface of the workpiece 40 to face the inkjet head 20 and the inkjet head 20 prints on each printing area.

It is to be understood that the present disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for printing on a surface, the method comprising:

providing a printing system comprising a rotating mechanism and a printer comprising an inkjet head having a plurality of nozzles;

configuring an image to be printed on the workpiece;

determining if a surface of the workpiece where the image is to be printed is curved;

if the surface is curved, dividing the image into at least two printing areas;

rotating the workpiece on the rotating mechanism, wherein the rotating mechanism rotates the surface of the workpiece to face the inkjet head;

preventing the image being printed on the workpiece becomes distorted by separating the at least two printing areas from each other by a buffer area, wherein a width of the buffer area is greater than a distance between a first nozzle of the inkjet head and a last nozzle of the inkjet head; and printing each of the at least two printing areas of the image on the surface of the workpiece.

2. The method as claimed in claim 1, if the surface of the workpiece is not curved, the printing system prints the image on the workpiece without dividing the image.

3. The method as claimed in claim 1 the image is divided according to at least two surfaces of the workpiece, wherein curvatures of the at least two surfaces are different.

4. The method as claimed in claim 3, wherein the step of printing further comprises printing the at least two surfaces of the workpiece in separate printing processes.

5. The method as claimed in claim 1, the workpiece is rotated such that distances from the plurality of nozzles of the printing head to each of the surface of the workpiece are maintained approximately constant.

* * * * *